US009635889B1

(12) United States Patent
Copeland et al.

(10) Patent No.: US 9,635,889 B1
(45) Date of Patent: May 2, 2017

(54) COOLING GARMENT

(71) Applicant: TDA Research, Inc., Wheat Ridge, CO (US)

(72) Inventors: Robert James Copeland, Wesminster, CO (US); Girish Srinivas, Broomfield, CO (US); John David Wright, Morrison, CO (US); Steven Charles Gebhard, Golden, CO (US)

(73) Assignee: TDA Research, Inc., Wheat Ridge, CO (US)

( * ) Notice: Subject to any disclaimer, the term of this patent is extended or adjusted under 35 U.S.C. 154(b) by 430 days.

(21) Appl. No.: 14/214,486

(22) Filed: Mar. 14, 2014

Related U.S. Application Data

(60) Provisional application No. 61/781,562, filed on Mar. 14, 2013.

(51) Int. Cl.
*A41D 13/005* (2006.01)
*A41D 1/04* (2006.01)

(52) U.S. Cl.
CPC ..... *A41D 13/0056* (2013.01); *A41D 1/04* (2013.01); *A41D 2400/62* (2013.01)

(58) Field of Classification Search
CPC ..... A41D 13/0025; A41D 13/002; A41D 13/005; A41D 27/28; A41D 31/0038; A41D 13/0056; A41B 9/00
USPC ..... 2/457, 458, 69, 81, DIG. 1
See application file for complete search history.

(56) References Cited

U.S. PATENT DOCUMENTS 4,451,934 A * 6/1984 Gioello ..... A41B 9/00 2/113
5,320,164 A * 6/1994 Szczesuil ..... A41D 13/005 165/46
5,515,543 A * 5/1996 Gioello ..... A41D 27/28 2/69
6,263,511 B1 * 7/2001 Moretti ..... A41D 27/28 2/410
2005/0172378 A1 * 8/2005 Messiou ..... A41D 27/28 2/115
2006/0070162 A1 * 4/2006 Frank ..... A41D 13/0025 2/69
2010/0011491 A1 * 1/2010 Goldmann ..... A41D 13/002 2/458

(Continued)

OTHER PUBLICATIONS

Sophia D'Angelo, The Cooling Vest-Evaporative Cooling, B.S. Thesis in chemical engineeering and mechanical engineering, Worcester Polytechnic Institute, Apr. 30, 2009.

(Continued)

*Primary Examiner* — Gloria Hale
(74) *Attorney, Agent, or Firm* — Brian J. Elliott

(57) ABSTRACT

The present invention relates to a cooling garment, comprising: a moisture-wicking under layer; and an impermeable outer layer, wherein the impermeable outer layer is attached to the moisture-wicking under layer forming at least one channel within the garment having a wetted perimeter of at most 5 inches; and an above ambient pressure gas supply operably attached to the channel. The present invention also relates to the cooling shirt or vest garment, comprising: a moisture-wicking under layer and an impermeable outer layer, wherein the outer layer is attached to the under layer forming a plurality of channels.

20 Claims, 18 Drawing Sheets

(56) References Cited

U.S. PATENT DOCUMENTS

| | | | | |
|---|---|---|---|---|
| 2010/0015373 | A1* | 1/2010 | Lin | A41D 31/0038 428/36.1 |
| 2010/0018682 | A1* | 1/2010 | Goldmann | F28D 21/0015 165/104.31 |
| 2010/0125928 | A1* | 5/2010 | Smith | A41D 13/0025 2/69 |
| 2014/0069617 | A1* | 3/2014 | Shelton | F41H 1/02 165/120 |

OTHER PUBLICATIONS

Cadarette, B.S.; Blanchard, L.; Staab, J.E.; Kolka, M.A. and Sawka, M.N. (2001) "Heat Stress When Wearing Body Armor," USARIEM Report T-01/9.

Cadarett, B.S. et al.. (2006) "Intermittent Microclimate Cooling During Exercise Heat Stress in U.S. Army Chemical Protective Clothing," Ergonomics, vol. 49, No. 2, 209-219.

Cadarett, B.S. et al. (1990) "Evaluation of Three Commercial Microclimate Cooling Systems," Aviation, Space and Environ. Med. Jan. 1990, 71-76.

Cadarett, B.S. et al. (2006) "Physiological Responses to Heat Stress in the Joint Protective Aircrew Ensemble (JPACE) Coverall with Varied Protective Eqpmt.," U.S. Army T07-02.

Cadarett, B.S.et al. (1988) "Physiological Responses to a Prototype Hybrid Air-Liquid Microclimate Cooling System During Exercise in the Heat," U.S. Army Report AD-A194 759.

Hudgens, G.A.et al. (1994) "Eval. of Stress Experienced by Soldiers Wearing Chem. Protective Clothing During Varying Work Loads in Desert or Tropical Environ.," ARL-TR-460.

Montain, S.J. et al. (1994) "Physiological Tolerance to Uncompensable Heat Stress: Effects of Exercise Intensity . . . and Climate," J. Appl. Physiol 77(1): 216-222.

Patterson, M.J. et al. (1998) "Physical Work and Cognitive Function During Acute Heat Exposure Before and After Heat Accumulation," Defense Science and Technology Organization.

Decristofano, B.S.et al. (1988) "Cooling Effectiveness of Hybrid Microclimate Garment," U.S. Army Report TR-88/003.

Epstein, Y. and Moran, D.S. (2006) "Thermal Comfort and the Heat Stress Indices," Ind. Health, 44, 388-398.

* cited by examiner

| | | Easy Work | | Moderate Work | | Hard Work | |
|---|---|---|---|---|---|---|---|
| Heat Category | WBGT Index, (F°) | Work/ Rest | Water Intake (Qt/h) | Work/ Rest | Water Intake (Qt/h) | Work/ Rest | Water Intake (Qt/h) |
| 1 | 78-81.9 | NL | ½ | NL | ¾ | 40/20 min | ¾ |
| 2 (Green) | 82-84.9 | NL | ¾ | 50/10 min | ¾ | 30/30 min | 1 |
| 3 (Yellow) | 85-87.9 | NL | ¾ | 40/20 min | ¾ | 30/30 min | 1 |
| 4 (Red) | 88-89.9 | NL | ¾ | 30/30 min | ¾ | 20/40 min | 1 |
| 5 (Black) | > 90 | 50/10 min | 1 | 20/40 min | 1 | 10/50 min | 1 |

Fig. 6

111

$$\frac{m_w}{A_{MT}} = k_{MT}\left(C_{water}^{sat} - C_{water}^{ambient}\right)$$

112

113 114 115

Fig. 18

COOLING GARMENT

CROSS REFERENCE TO RELATED APPLICATIONS

The present application claims the benefit of the provisional application No. 61/781,562 filed Mar. 14, 2013 (titled COOLING GARMENT, by Robert James Copeland, Girish Srinivas, John David Wright and Steven Charles Gebhard, which is incorporated by reference herein. Provisional application No. 61/781,562 is not admitted to be prior art with respect to the present invention by its mention in the background or cross-reference section.

BACKGROUND

When fire fighters, first responders, military personnel or construction workers overheat in hot, humid climates, they not only lose effectiveness and risk heat exhaustion and heat stroke, but can suffer significant cognitive impairment. While workers can remain safe by taking frequent rest breaks, time pressure to complete work frequently results in employees skipping rests, which can lead to heat related illness, some of which can be life threatening. For example, a 70-kilogram (154 lb), physically fit individual engaged in very heavy work (such as digging with a shovel) generates about 2000 Btu/hr (586 W) of heat. The heat capacity of tissue is about 3.5 kJ/kg° C. (0.836 Btu/lb° F.) and in the absence of any heat losses, absorbing this much heat will raise the body's core temperature from 37° C. (98.6° F.) to 40° C. (104° F.) in about 20 min. When the body's temperature reaches 104° F., the result is heat stroke, which is a medical emergency. At this core temperature, the body loses its ability to regulate temperature, and cannot cool itself down. If untreated, heat stroke can lead to permanent disability or death. Less severe but still serious, heat exhaustion occurs at somewhat lower core body temperatures (i.e. the body's thermoregulatory system is still functioning). Symptoms include: heavy sweating, paleness, muscle cramps, fatigue, weakness, dizziness, headache, nausea and sometimes brief loss of consciousness (fainting). While less severe than heat exhaustion, even mild overheating can cause painful muscle cramps and heat rash.

Sweating cools the body in all but the very hottest of dry climates (Sawka, M. N and Pandolf, K. B. (2002) "Physical Exercise in Hot Climates: Physiology, Performance, and Biomedical Issues," Chapter 3 "Physical Exercise in Hot Climates: Physiology, Performance, and Biomedical Issues," in Medical Aspects of Harsh Environments, Volume 1, Textbooks of Military Medicine, Office of the Surgeon General, Department of the Army, USA; D. E. Lounsbury; R. F. Bellamy and R. Zajtchuk (editors). However, in hot, humid climates, the cooling effect of sweating is generally not effective because of the body's limited surface area and because the rates of mass transfer from the liquid phase (sweat) to vapor phase are low (because high ambient humidity lowers the driving force for the evaporation of water). While a person can be cooled in humid climates using air conditioning, ice, circulating liquid cooling systems, cold packs and phase change materials, these methods are frequently impractical because of their weight and size. For ice, cold packs and phase change materials, a refrigerator or freezer is needed to regenerate the materials, which may be unavailable. Further, these devices are not self-regulating and therefore do not respond to changes in the metabolic heat load; they keep cooling even when the worker is at rest, causing overcooling.

Three methods for personal cooling are: 1) ice/phase change packs, 2) liquid cooling systems and 3) forced air cooling. Ice packs and phase change materials are held in pouches or pockets sewn into a vest and heat is removed as the ice or phase change material melts. Ice is better than phase change materials because it has a higher heat of fusion ($\Delta H_{f\ water}$=143 Btu/lb) and can therefore remove more heat per unit weight. While ice packs are simple, they have several disadvantages that make them impractical for mobile personal cooling; they are heavy (about 1000 g/L), overcool the wearer initially and undercool later, are dead weight after they melt, and need a freezer for regeneration. Liquid cooling systems are complex, heavy and can be hazardous in some situations. They require a pump (and large, heavy batteries to operate it), a heavy liquid reservoir and an electronic feedback system (vulnerable to failure) for temperature control. Natural (sweat) cooling uses air to evaporate sweat; the heat of vaporization of water is about 1000 Btu/lb, which is 7 times greater than the heat of fusion for melting ice. The problem is that in humid climates, sweat usually cannot evaporate fast enough to provide adequate cooling unless there is significant air movement.

Clothing and protective equipment can severely restrict the flow of air, and this interferes with the evaporative cooling effects of sweating. This is bad enough in a hot, dry climate, but in hot, humid environments, this can be extremely uncomfortable (which is a distraction) and potentially dangerous (if it results in heat exhaustion or heat stroke). Heat stress when wearing clothing and protective gear and the effectiveness of existing personal cooling technologies (frequently referred to as microclimate technologies) has been studied to determine both the physiological and psychological effects of overheating on the ability of people to perform a wide variety of tasks that require different levels of exertion (Cadarette, B. S.; Cheuvront, S. N.; Kolka, M. A.; Stephenson, L. A.; Montain, S. J. and Sawka, M. N. (2006) "Intermittent Microclimate Cooling During Exercise Heat Stress in U.S. Army Chemical Protective Clothing," Ergonomics, Vol. 49, No. 2, 209-219). The amount of metabolic heat generated depends on the task that the worker is performing. Effort is therefore broadly divided into four categories: 1) very light work generates 105-175 W; 2) light work generates 175-325 W; 3) moderately heavy work generates 325-500 W; and 4) extremely hard work can produce more than 600 W of heat that must be removed. Especially for moderate to heavy work, frequent rests are required unless there is an active microclimate cooling technology being used by the worker. As expected, the harder the work, and the hotter and more humid the environment, the less time that can be spent working.

While ambient temperature and relative humidity provide guidelines for working in hot, humid climates are available, they do not account for radiative heating when a person is working in the sun. Therefore, formulas that use weighted combinations of dry bulb temperature, wet bulb temperature and in some cases the black globe temperature have been developed to calculate various heat indices (Epstein, Y. and Moran, D. S. (2006) "Thermal Comfort and the Heat Stress Indices," *Ind. Health,* 44, 388-398). These indices are then correlated with experiments done with human volunteers to determine the weighting factors for each type of temperature. The basic idea is that an index provides a single number that fully describes the work environment. Human physiology and the psychological perception of heat and humidity are very complex, so a heat index provides a rough guideline. One commonly used index is the Wet Bulb Globe Temperature (WBGT) Index. It is calculated using the wet bulb temperature ($T_{nwb}$), the black globe temperature ($T_{bg}$), and the dry bulb temperature ($T_{db}$). The dry bulb temperature is the temperature measured outdoors away from direct sunlight. The wet bulb temperature is the temperature measured using a sling psychrometer, and the black globe temperature is the temperature of the air contained in a black sphere that absorbs most of the solar radiation. The WBGT is calculated from $WBGT=0.7T_{nwb}+0.2T_{bg}+0.1T_{db}$ when outdoors in the sun, and $WBGT=0.7T_{nwb}+0.3T_{bg}$ when indoors or in the shade. For low values of WBGT (in the twenties ° C.) heavy work can be continuously done without danger of overheating, but as the WBGT increases, progressively less time can be spent working safely without periodic resting. FIG. 6 shows recommended work/rest cycles and required water intake as a function of WBGT.

The only safe way to extend the time for heavy work when the WBGT is high is to have some way to cool the individual. Indoors, this might be as simple as using an electric fan or air conditioning. The problem is that all of the portable systems that one might consider for outdoor use fall short in one or more respects. There are three ways to actively remove metabolic heat from the body using portable systems: 1) ice/cold packs and other phase change materials, 2) liquid cooling and 3) air cooling. Each method has advantages and disadvantages. The advantage of ice/cold packs and phase change materials is that they are simple—the person wears a vest that contains pockets that hold the packs. Unfortunately, the disadvantages of ice/cold packs and other phase change materials outweigh their advantages and include: 1) the need for an external refrigerator/freezer to regenerate the packs, 2) the packs are deadweight once they are spent/thawed, but still need to be carried if they are going to be reused, and 3) there is no temperature control so they cannot be turned off when resting or when the work load is reduced. This is a serious problem since any system that has enough capacity to remove the heat generated during heavy work has more than enough capacity to dangerously overcool the user.

Liquid cooling systems circulate water through tubes next to the skin and their main advantage is that they have high heat transfer rates. Unfortunately, liquid systems require a refrigeration/chiller system to reject the heat from the warmed water and these are heavy, consume large amounts of power (thus requiring heavy batteries in a portable garment), and unless they use a complicated feedback temperature control system, they can overcool the user. In addition, a vest that uses liquid filled tubes (usually water) is heavy (1 kg/liter for just the water). Thus, a liquid cooling system means one has to carry a small refrigeration unit, which in addition to already being heavy and complex, has a very low efficiency (refrigeration system efficiency increases with increasing size).

Sophia D'Angelo, & William Lauwers, Apr. 30, 2009 ("The Cooling Vest-Evaporative Cooling", a Major Qualifying Project Report in fulfillment of a Bachelor of Science Degree, Worchester Polytechnic Institute, Chemical Engineering and Mechanical Engineering, advised by Anthony Dixon) teaches a cooling vest containing an inner wicking layer, a middle mesh liner, and an outer shell. The vest contains a thermoelectric cooler and a powered fan to blow air over the thermoelectric cooler, providing air that is cooler than ambient air, which is then forced through the vest in the space between the wicking layer and the outer shell layer (See page 42). It further teaches a vest containing "thick Styrofoam" (page 42) structural supports that separate the wicking layer from the outer shell layer and that form channels to direct the airflow direction starting near the waist and flowing up and out the arm holes. Heat exchangers are added to improve the transfer of heat from the hot and cold sides of the thermoelectric cooling device (see pages 44-47). D'Angelo & Lauwers (2009) is incorporated by reference herein.

These references contain at least one of the following limitations: there are no small channels to control the rate of mass transfer of evaporated sweat, the garment is heavy, the garment requires consumables such as ice, the garment can over cool the wearer, or the garment is ineffective in hot and humid environments.

Thus, there is a need for a light, portable cooling technology that can be used by first responders, construction workers, fire fighters, military personnel and others to prevent heat exhaustion or heat stroke when working in hot or humid environments.

BRIEF SUMMARY OF THE INVENTION

The present invention relates to cooling garments and solves the limitations of the prior art. The invention is a cooling garment, which can prevent heat related illnesses, especially heat exhaustion and heat stroke. A feature of this garment is that it does not require consumables (other than electricity for rechargeable batteries in a portable garment), water, or, cumbersome equipment. Another feature is that the cooling garment prevents both overheating and overcooling.

The present invention is a cooling garment, comprising: a moisture-wicking under layer; a low permeability outer layer, wherein the low permeability outer layer is attached to the moisture-wicking under layer; at least one channel within the garment having a wetted perimeter of at most 5 inches; and an above ambient pressure gas supply operably attached to the channel. In one embodiment the wetted perimeter is made from the moisture-wicking under layer. In another embodiment, the garment has at least two channels, wherein the two channels are substantially adjacent to each other. In a separate embodiment the garment has at least two channels, and at least one gap, wherein the two channels are separated by the gap. In a preferred embodiment the hydraulic diameter of the channel is at most 1 inch, more preferably the hydraulic diameter is about 0.5 inches. In a further embodiment, the above ambient pressure gas supply is either a fan, a positive displacement pump, a compressed gas tank, a breathing air tank, a mouth or a nose. The garment can have a variety in the number of channels and the channels can be different sizes. In one embodiment the garment is a shirt or a vest with at least 20 channels.

The present invention also relates to a cooling shirt, comprising: a moisture-wicking under layer (2); a low permeability outer layer (3), wherein the low permeability outer layer is attached to the moisture-wicking under layer; at least one channel (4) within the garment having a wetted perimeter of at most 5 inches; and an above ambient pressure gas supply operably attached to the channel. In one embodiment the wetted perimeter is made from the moisture-wicking under layer. In another embodiment, the garment has at least two channels, wherein the two channels are substantially adjacent (8) to each other. In a separate embodiment the garment has at least two channels, and at least one gap (9), wherein the two channels are separated by the gap.

In another embodiment the present invention is a cooling garment (10), comprising: a moisture-wicking under layer (11); a low permeability outer layer (12), wherein the outer layer is attached to the under layer forming a plurality of channels (13), each of the channels has a cross section (20) comprising: a wicking layer segment (21) having a wicking layer cross section width (22), wherein, the wicking layer cross section width is at most 2 inch; and an outer layer segment (23) having an outer layer cross section width (24), wherein the outer layer cross section width is at most 3 inches; and an above ambient pressure gas supply (14) operably attached to the channels with a manifold (15). In an embodiment the channels have a wicking layer cross section width of at most 0.2 inches. In another embodiment, the channels are semicircular tubes with a diameter from 0.04 to 1.0 inches, more preferably about 0.5 inches, and alternatively from 0.04 to 0.2 inches. In one embodiment the garment is shirt with 300 to 400 channels. Alternatively, the garment is a shirt or a vest with at least 20 channels.

In an embodiment the channels are triangular pleats having a wicking layer cross section width from 0.04 to 1.0 inches, preferably from 0.04 to 0.2 inches.

The channels in of the garment can have an airflow direction that is either substantially up, substantially down, or substantially horizontal, or combinations thereof. The garment may also have at least one redistribution manifold (16).

The outer layer has at least a low permeability (also called semi-permeable), but in one embodiment the outer layer is impermeable.

In yet another embodiment the present invention is a cooling garment (10), comprising: a moisture-wicking under layer (11); a low permeability outer layer (12), wherein the outer layer is attached to the under layer forming a plurality of channels (13), each of the channels has a cross section (20) comprising: a wicking layer segment (21) having a wicking layer cross section width (22), wherein, the wicking layer cross section width is at most 2 inch; and an outer layer segment (23) having an outer layer cross section width (24), wherein the outer layer cross section width is at most 3 inches; wherein at least one of the channels (13) has a cross section (20) further comprising: at least one wall segment (25), having a wall cross section width (26), wherein the wall cross section width is at most 0.5 inches; and wherein the cross section (20) has a total wetted perimeter (27) of no more than 5 inches; and the garment has an above ambient pressure gas supply (14) operably attached to the channels with a manifold (15). In an optional embodiment the channels are substantially rectangular channels with a wicking layer cross section length (22) from 0.1 to 1.0 inches, an outer layer cross section length (24) from 0.1 to 1.0 and a wall cross section length (26) from 0.1 to 0.5 inches.

BRIEF DESCRIPTION OF THE DRAWINGS

FIG. 6. Recommended exercise/rest cycles hot, humid climates without external cooling (WBGT in ° C.).

FIG. 18. Water vapor flux equation.

DETAILED DESCRIPTION OF THE INVENTION

Figure 1:
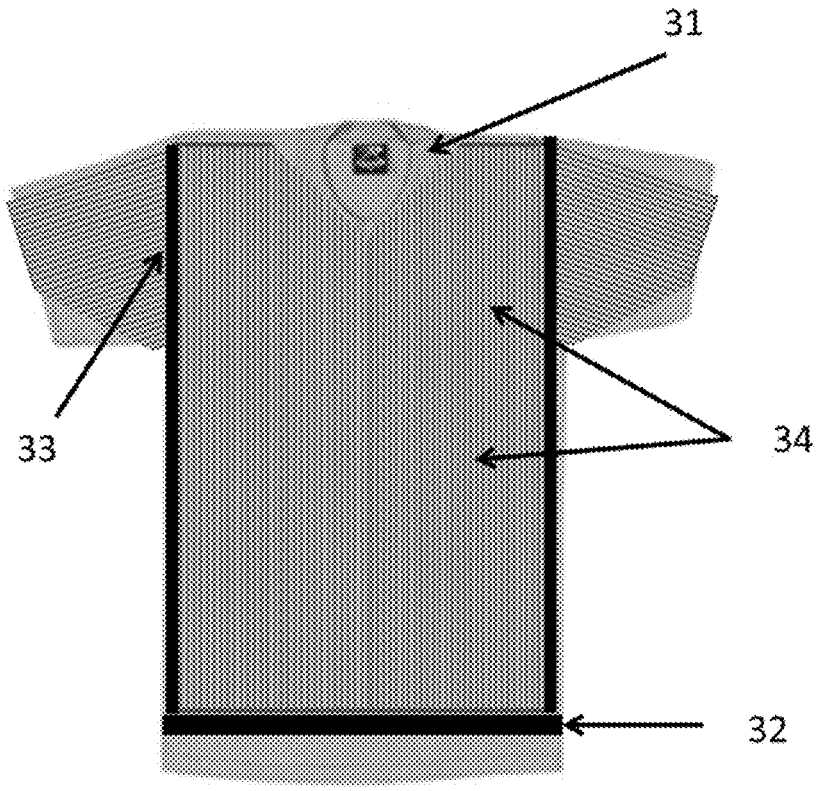
FIG. 1. Schematic of one method of attaching air flow tubes to the moisture wicking garment.

In the summary of the invention above and in the Detailed Description of the Invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, and article "comprising" (or "which comprises") component A, B, and C can consist of (i.e. contain only) components A, B, and C, or can contain not only components A, B, and C but also one or more other components.

The term "at least" followed by a number is used herein to denote the start of a range beginning with that number (which may be a range having an upper limit or no upper limit, depending on the variable being defined). For example, at least 1" means 1 or more than 1. The term "at most" followed by a number is used herein to denote the end of a range ending with that number (which may be a range having 1 or 0 as its lower limit, or a range having no lower limit, depending on the variable being defined). For example, at most 4" means 4 or less than 4, and "at most 40%" means 40% or less than 40%. When, in this specification, a range is given as "(a first number) to (a second number)" or "(a first number)–(a second number)", this means a range whose lower limit is the first number and whose upper limit is the second number. For example 25 to 100 mm means a range whose lower limit is 25 mm, and whose upper limit is 100 mm.

Above ambient pressure gas supply means a device capable of providing a gas at a pressure higher than the ambient pressure outside the garment. The device can generate higher than ambient pressure from ambient air, or it may have pressurized gas in a container. Non-limiting examples of devices that generate higher than ambient pressure gas may include a pump, a fan, a positive displacement pump, a blower, and the like. Non-limiting examples of devices that have pre-pressurized gas in a container may include a compressed gas tank or a compressed breathing air tank and the like. Another example of an ambient pressure gas supply is air expelled by a person's mouth or nose. The gas may be ambient air, ambient air that has been conditioned to alter the temperature or humidity or a compressed gas: non-limiting examples include $CO_2$, $N_2$, Ar, $O_2$, mixtures thereof, and the like. The word "supply" in the phrase "above ambient pressure gas supply" is a noun.

Garment means an item of clothing and may include a shirt, a vest, a collar, trousers, a pair of shorts, a hat, a sweat band, and the like.

Wetted perimeter means the internal surface of the channel that is in direct contact with the gas that is flowing inside the channels. The perimeter is the distance around the internal surface of the cross section of the channel. Wetted perimeter is further taught in Fundamentals of Heat and Mass Transfer by Theodore L. Bergman, Adrienne S. Lavine, Frank P. Incropera, David P. DeWitt, April 2011, 2011, which is incorporated by reference herein.

Channel means a high aspect-ratio passage which air or gas can pass through. Channels in the present invention are contained within the wicking layer, or within the wicking layer and the outer layer.

Hydraulic diameter is a term understood by A Person Having Ordinary Skill in the Art and is a commonly used term when handling flow in noncircular tubes and channels. Hydraulic diameter is further defined in Fundamentals of Heat and Mass Transfer by Theodore L. Bergman, Adrienne S. Lavine, Frank P. Incropera, David P. DeWitt, April 2011, 2011, which is incorporated by reference herein.

The channel width to length ratio is designed to provide cooling for the wearer. It is understood by a Person Having Ordinary Skill in the Art that adjusting this ratio will change the efficiency of the evaporator, and subsequently affect the cooling of the garment.

Sweating does not provide adequate cooling when the ambient humidity is high. The cooling garment is designed to overcome this problem to prevent heat related illness even in very hot and humid climates. The cooling garment is small, portable, for example it may weigh less than about 4 pounds, and is self-regulating and will not overcool the user. It can be easily carried by the worker and can provide safety and comfort to people working in hot, humid climates.

The cooling garment cools workers in both hot-humid and hot-dry climates, using the body's natural, self-regulating cooling mechanism of sweat evaporation to cool the skin. In one embodiment the cooling garment consists of a small fan that blows air through a specially designed garment that is worn over the torso (FIG. 1). The garment is made from a material that wicks sweat away from the skin and into an array of small flexible (for example plastic, fabric, coated fabric) semicircular or other cross-sectional geometry tubes through which air is forced by a fan. Sweat is evaporated into the air that is flowing through the tubes, and is vented out the ends of the shirt sleeves and around the neck, for example and other configurations are possible. This technology works even in humid climates because small diameter tubes have hydraulic diameters that increase the rate of mass transfer for evaporating water from the sweat (liquid phase) to the air (vapor phase). The result is that the sweat can evaporate at a rate that can keep up with the rate of metabolic heat generation, even in humid environments. Sweat can be used for evaporative cooling, even in very humid climates, because ambient air is almost never saturated with water (e.g. typical relative humidity levels even along the U.S. Gulf Coast are 40-80%, not 100%). In other words, the problem in humid climates is not that sweat cannot evaporate, but that sweat cannot evaporate fast enough because of the body's low surface area and the low driving force for mass transfer in humid climates. As a result, normal sweating cannot keep up with the metabolic heat load in the absence of a substantial air flow. The cooling garment increases the rate of sweat evaporation to the point that cooling is possible, even in very humid climates.

The cooling garment works by blowing air through small channels in the cooling garment (for example a shirt), evaporating the user's sweat and keeping them cool. Blowing air through small channels with laminar flow is more effective at evaporating water (sweat) than the same velocity of air blowing over the surface of the skin. The figures show the airflow direction upward as a non-limiting example. The cooling garment can also have cooling tubes aligned in other directions including, but not limited to, horizontal and vertical and diagonal or curved with downward airflow.

Figure 2:
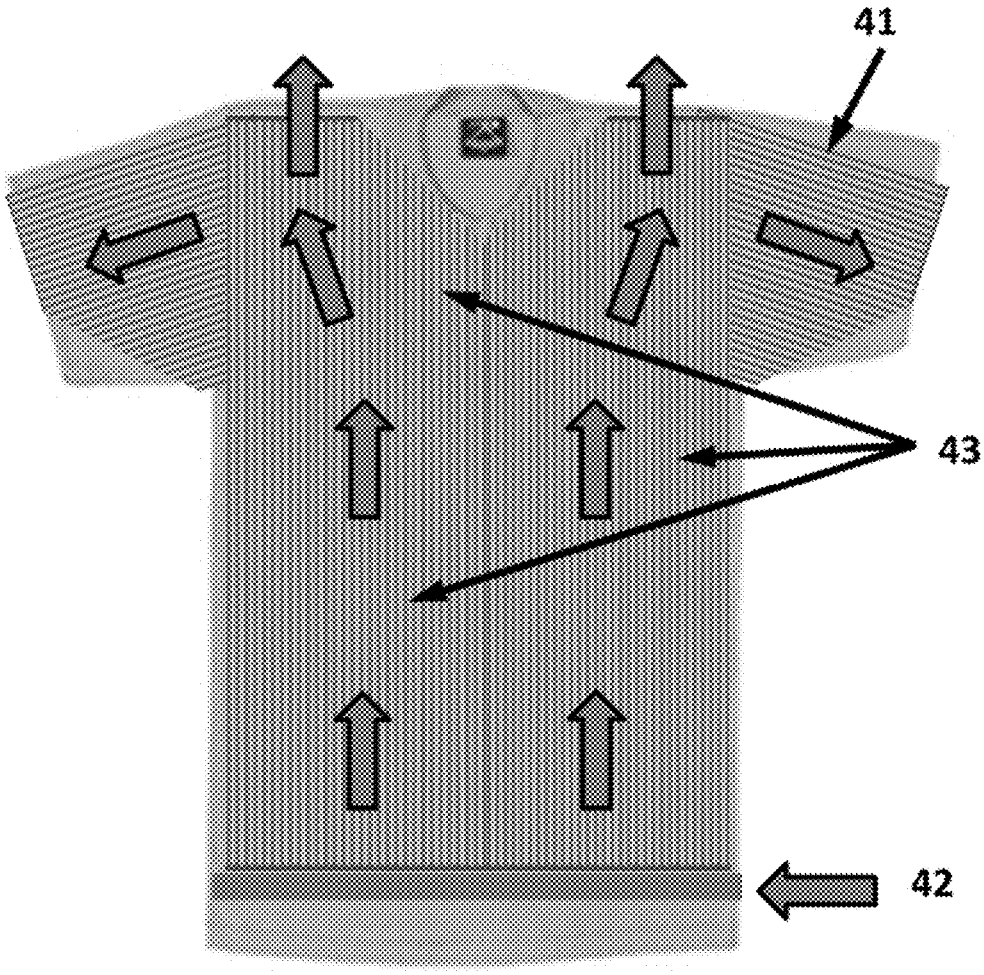
FIG. 2. Schematic of air flow tubes with an example of the flow direction.

FIG. 1 shows a schematic of one method of attaching air flow tubes to the moisture wicking garment, including sweat wicking garment layer (31), inlet manifold front and back (32), distribution manifolds (33) and vertical cooling tubes that have small hydraulic diameters attached to the sweat-wicking layer (34). FIG. 2 shows a schematic of air flow tubes with an example of the flow direction, including sweat-wicking fabric undergarment (41), air inlet from small fan—a horizontal fabric tube that wraps around bottom of shirt (42) and cooling tubes (43) created by stitching a pleated layer of densely woven fabric on top of wicking tee-shirt. Air flows up torso and out neck and sleeves providing evaporative cooling.

The cooling garment uses a lightweight, portable power source such as a battery. For example, a NiMH battery that lasts 4 hours weighs about 1.25 lb (~600 g). Also, because the cooling garment uses evaporative cooling, it is lighter than either ice packs/phase change or liquid cooling systems. For example, removing 250-400 W (850-1400 Btu/hr) of metabolic heat (moderate to hard work) requires melting 6-10 lb of ice, whereas it only requires evaporating about 0.85-1.4 lb of sweat (water that the person wearing the garment must drink anyway).

Figure 3:
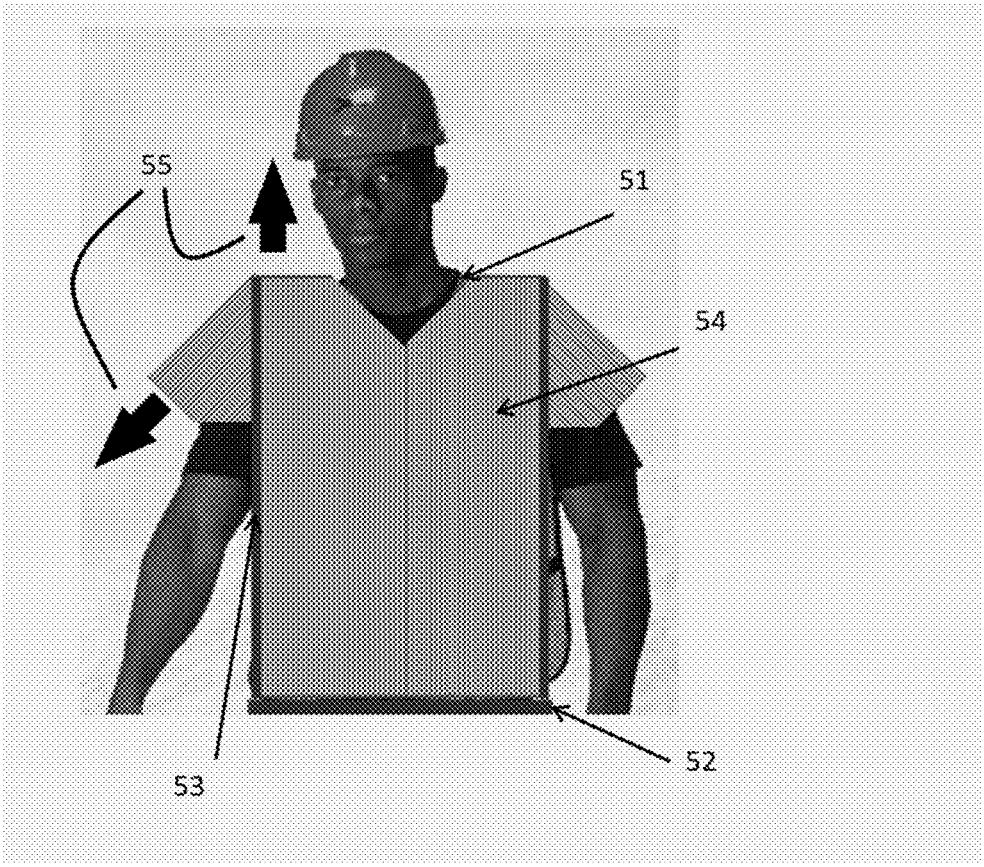
FIG. 3. Schematic of the cooling garment in use.
Figure 4:
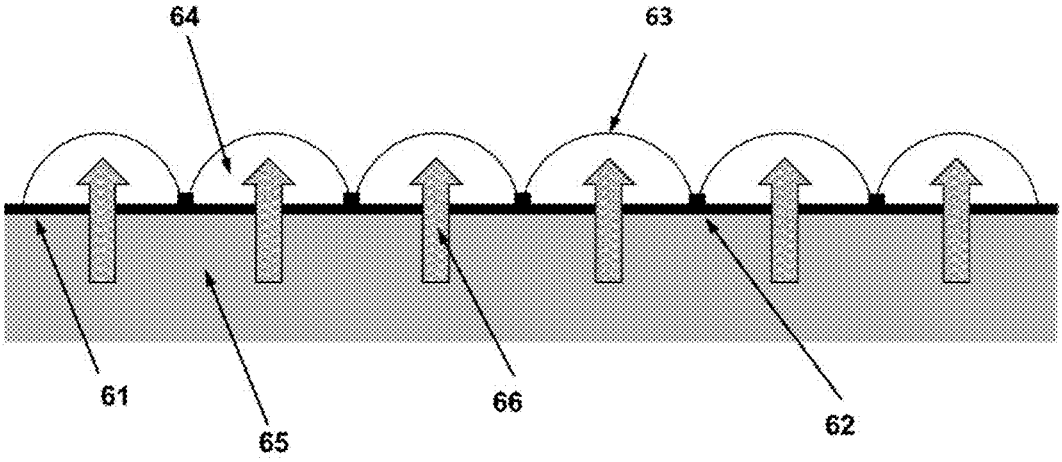
FIG. 4. Drawing of how air flow tubes are attached to the moisture wicking inner layer of the garment.

The cooling garment may have a small fan that blows air through a specially designed garment that is worn over the torso. The garment is made from a material that wicks sweat away from the skin and distributes it through the fabric into an array of small, flexible (plastic, tight woven/low permeability fabric, coated fabric, etc.) half tubes through which air is forced by a fan (FIG. 3 and FIG. 4). Sweat is evaporated into the air flowing through the tubes and is vented out the ends of the shirt sleeves and around the neck, for example, but other tube and vent configurations can be used. FIG. 3 shows a schematic of the cooling garment in use, including a close fitting sweat-wicking garment layer (51), an inlet manifold front and back (52), distribution manifold (53) vertical cooling tubes attached to garment, and direction of air flowing out (55).

Figure 10:
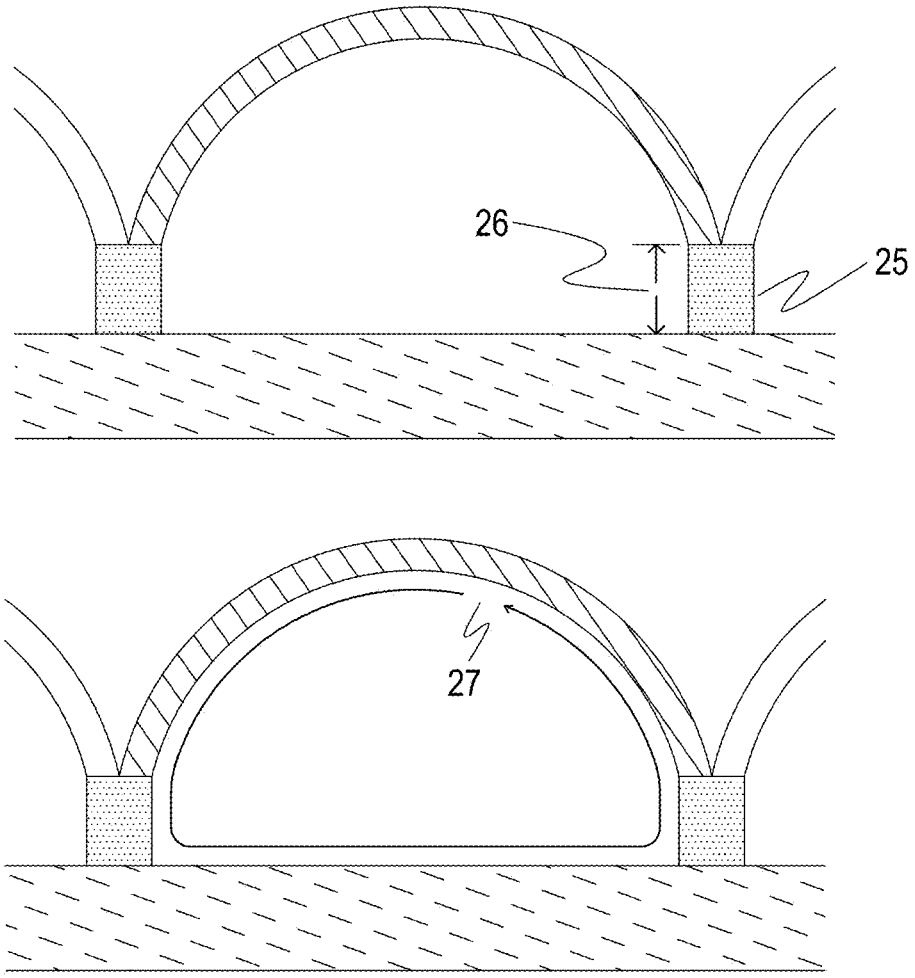
FIG. 10. Channels with a wicking layer segment, a low-permeability outer layer segment and a wall segment, example shows two wall segments.
Figure 11:
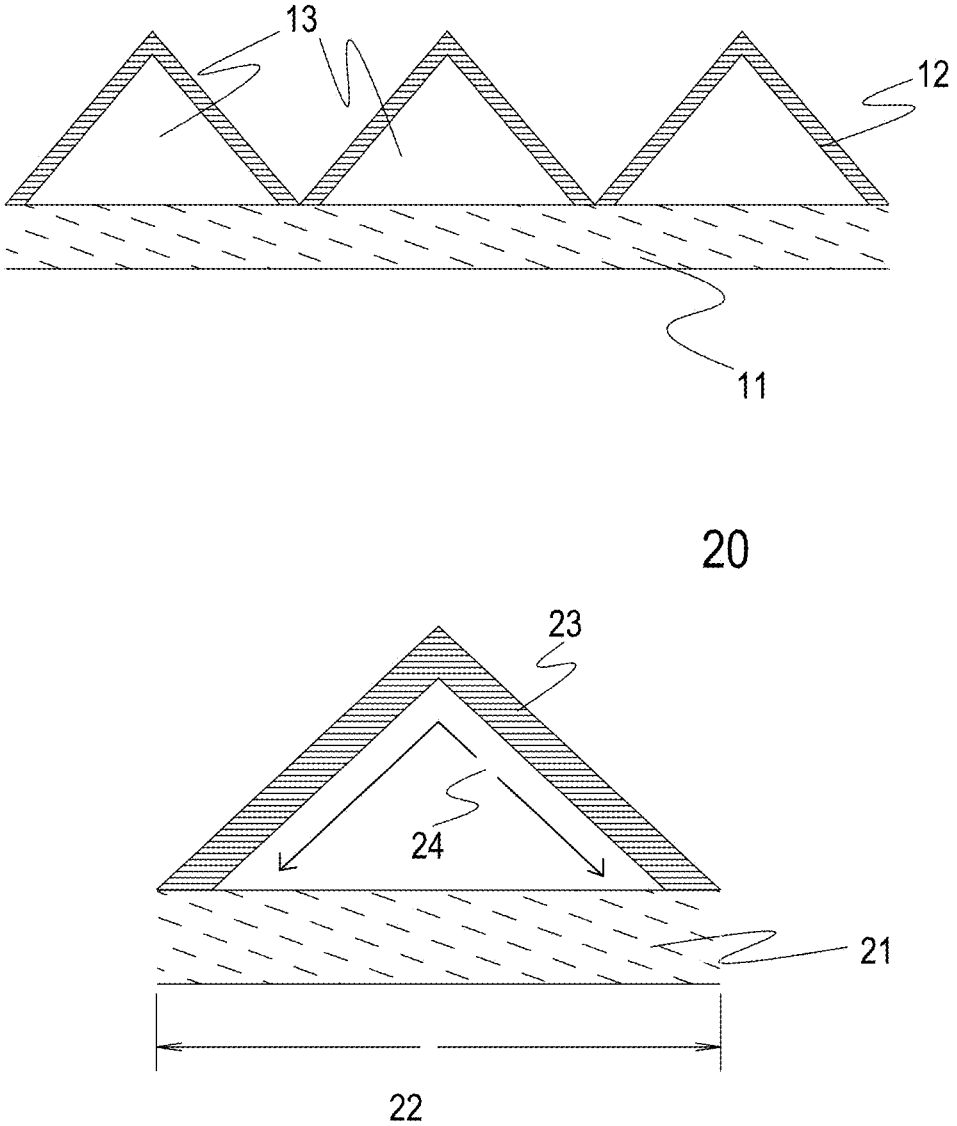
FIG. 11. Triangular pleat channel.

The cooling garment may weigh less than about 4 lb, and may have a battery (examples include rechargeable lithium batteries, NiMH batteries, and others). Because of its light weight, simplicity and portability, the cooling garment provides a level of safety and comfort to those working in hot, humid climates. FIG. 3 shows how the cooling garment can be worn by first responders, construction workers and other personnel. The moisture wicking shirt with attached semicircular tubes (other embodiments of this invention include tubes with similar geometries including triangles, squares, ellipses, etc.) is worn next to the skin (tubes out) and the fan and batteries are worn on a belt, for example. The tubing runs from the fan to a manifold at the bottom of the garment, air flows upward through the many tubes in the shirt and exits through the sleeves and around the neck. A cross section of the tubing and how it is attached to the wicking fabric is shown in FIG. 4 and FIG. 10, which illustrate non-limiting examples using semi-circular tubes. For example, FIG. 4 shows a drawing of how air flow tubes are attached to the moisture wicking inner layer of the garment, moisture wicking fabric (61), attachment points (62) connecting to a non-porous coating (63) forming airflow passages (64) that are about 0.1 inch diameter and used to cool the adjacent skin (65) by transporting water from sweat (66).

There are a number of synthetic "technical" fabrics that are specifically designed to wick moisture away from the skin to the outer layer of the garment where it can evaporate. These fabrics are suitable for use as the base/sweat wicking material for the cooling garment. They may be strong, durable, comfortable, and have excellent moisture wicking properties. Some examples are Supplex®, Meryl®, Dual Fit Strong® (MITI, Italy) and Coolmax® (DuPont—now Invista).

The tubing used to channel the air across the moisture wicking garment needs to be flexible enough that it does not interfere with the wearer's movement but stiff enough that it will not easily be collapsed or be crushed. Even if quite a few tubes are temporarily pinched off, this will not adversely affect the performance of the garment because it has about 440 tubes (assuming a chest circumference of 44 inches and 0.1 inch×0.1 inch cross section tubes), and a large excess of cooling capacity. In addition, intermediate manifolds can be added to reroute air around obstructed channels. Examples include semi-permeable fabric tubing stitched onto the wicking garment in a pleated fashion, or half tubes made from synthetic materials such as medical grade poly-vinyl chloride (PVC, basically Tygon®) and linear low density polyethylene (LLDPE) (Kissin 2005). Also, there is clearly a tradeoff between comfort and the intended use. For example, if the cooling garment is to be worn either as an outer garment or under a light shirt there is little reason to use crush resistant tubing and the garment could be very supple and flexible; an application where fabric tubing would be suitable. However, if it is to be worn under firefighting or military equipment, then crush resistance would be more important. In this case more rigid tubing used in the medical fields and in space suits may be suitable.

Figure 5:
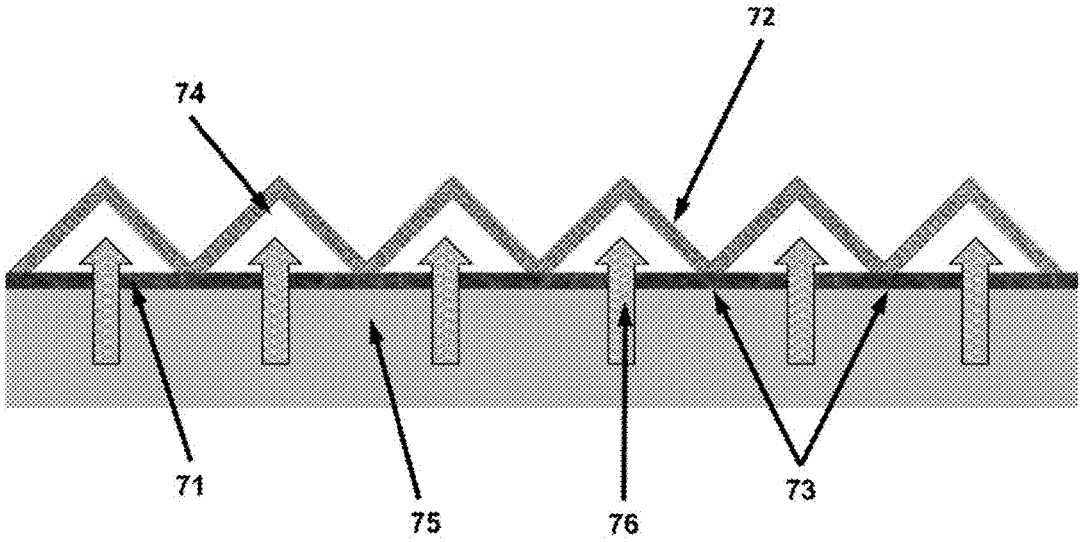
FIG. 5 Diagram of how fabric layers are attached to form air tubes used for evaporative cooling (cross-section of cooling shirt/vest).
Figure 7:
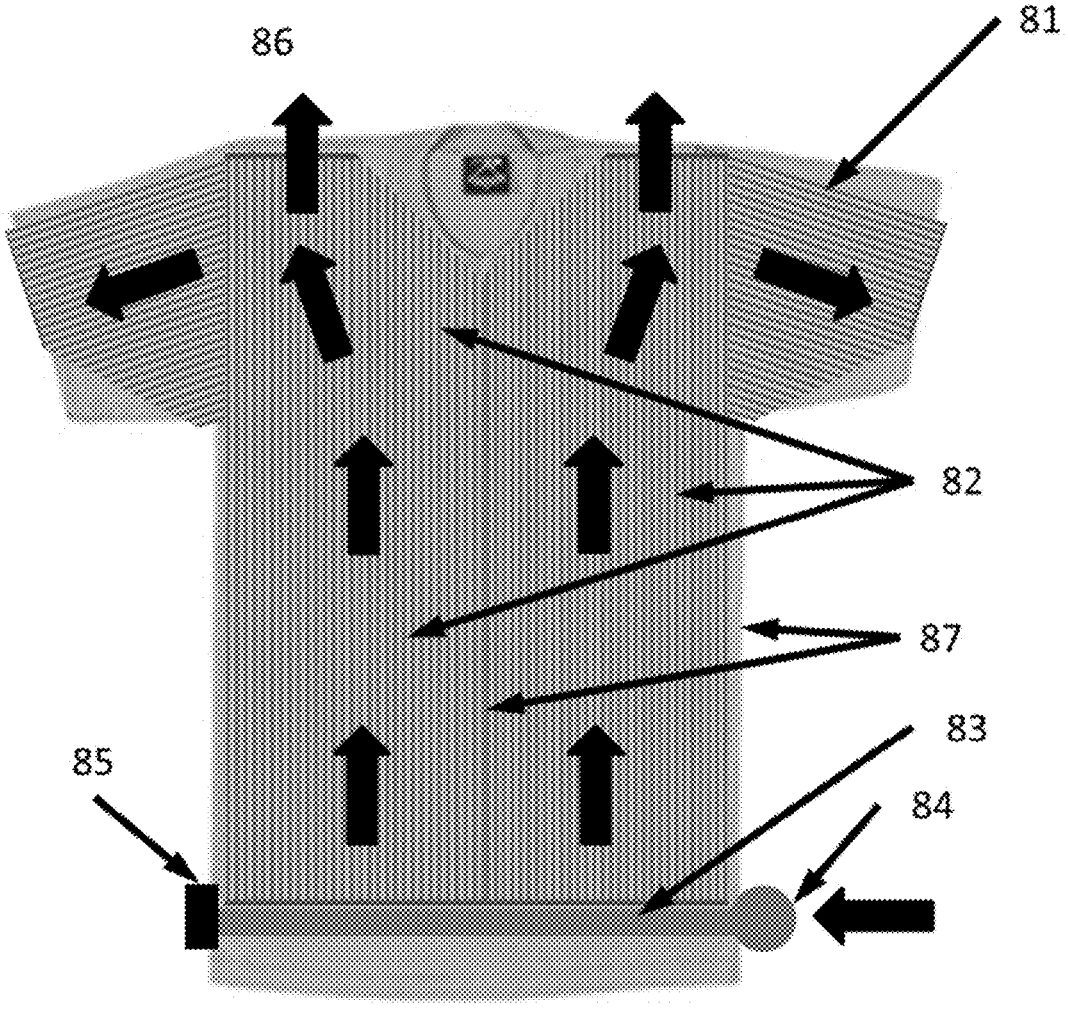
FIG. 7. Schematic of a cooling garment.
Figure 8:
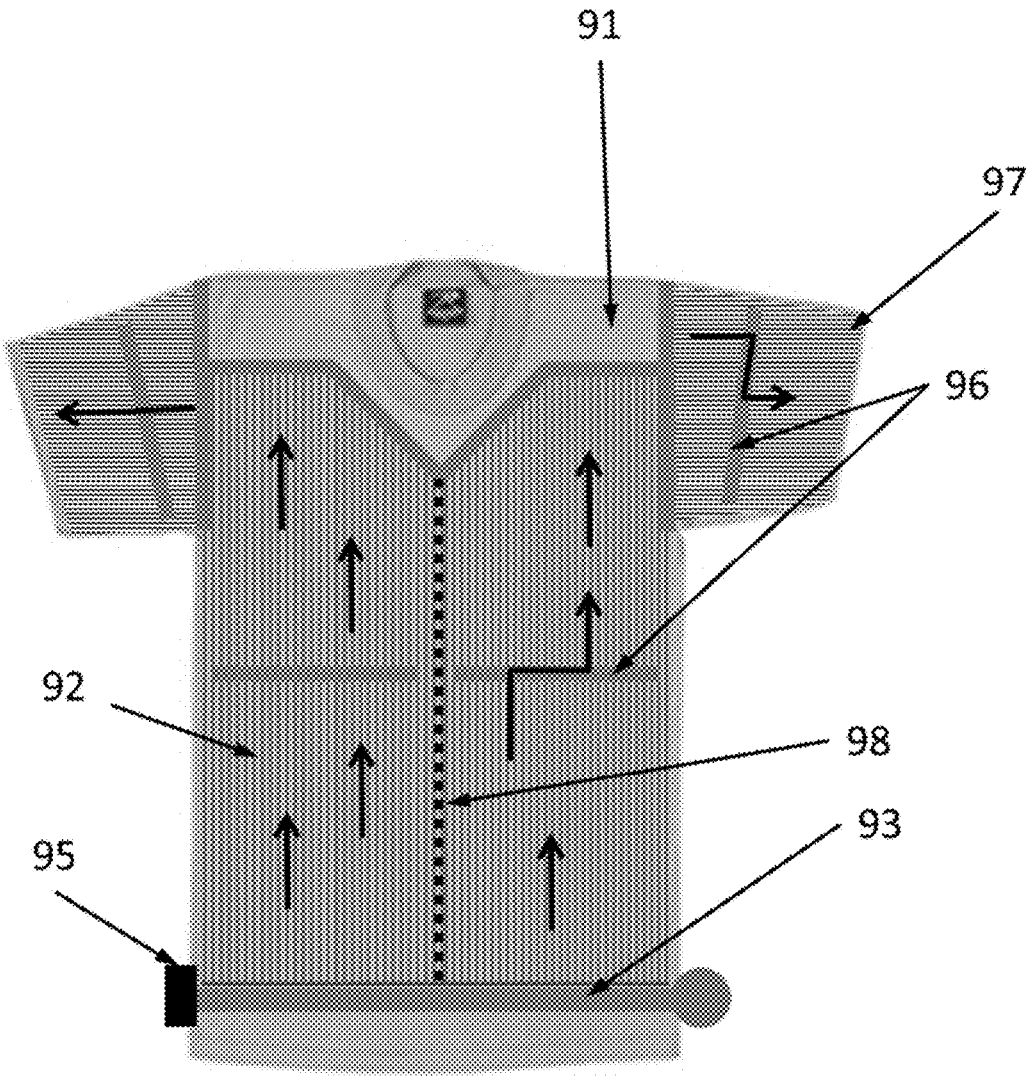
FIG. 8. Schematic of a cooling garment with a redistribution manifold.
Figure 9:
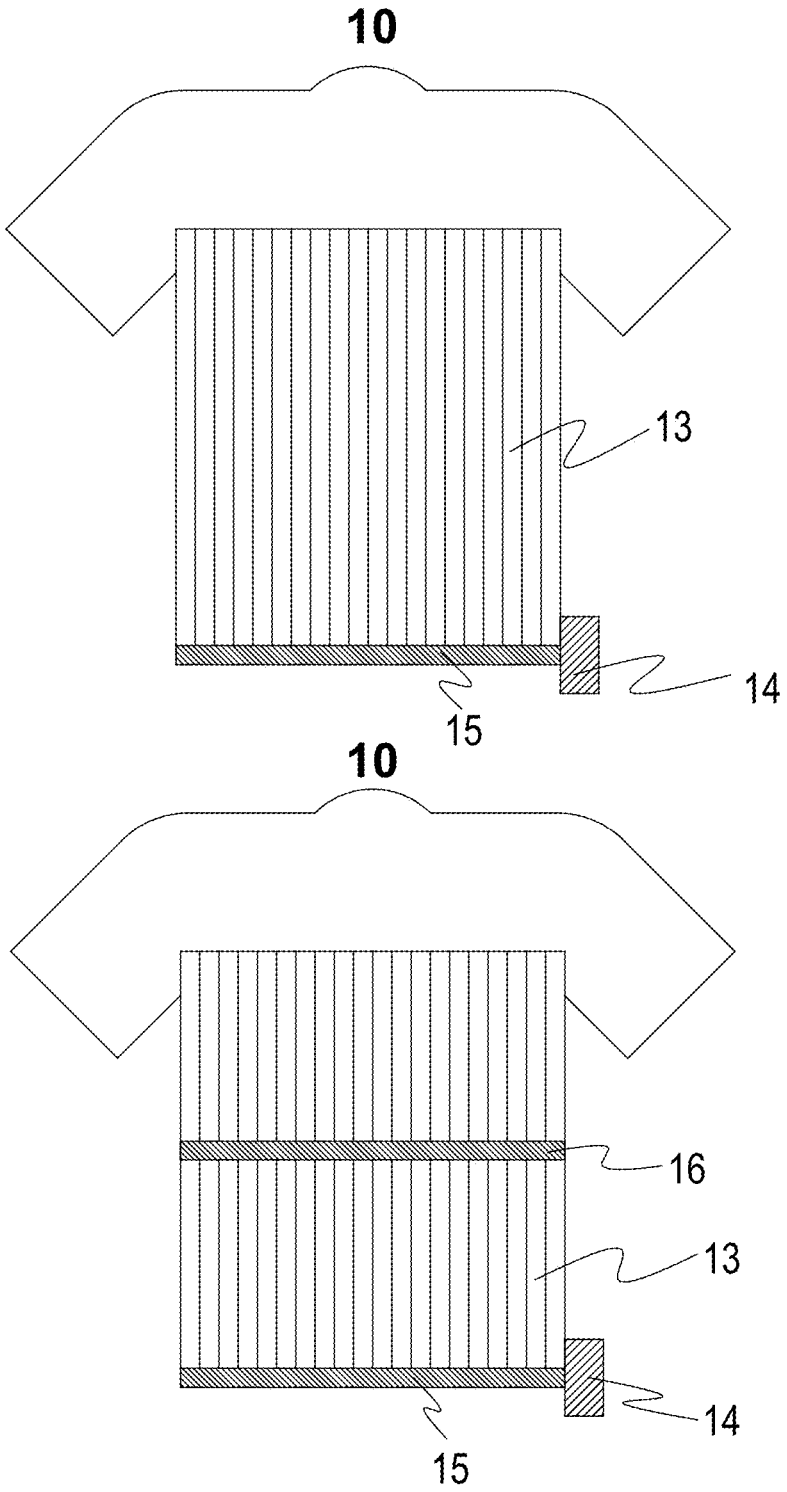
FIG. 9. Cooling garment.
Figure 15:
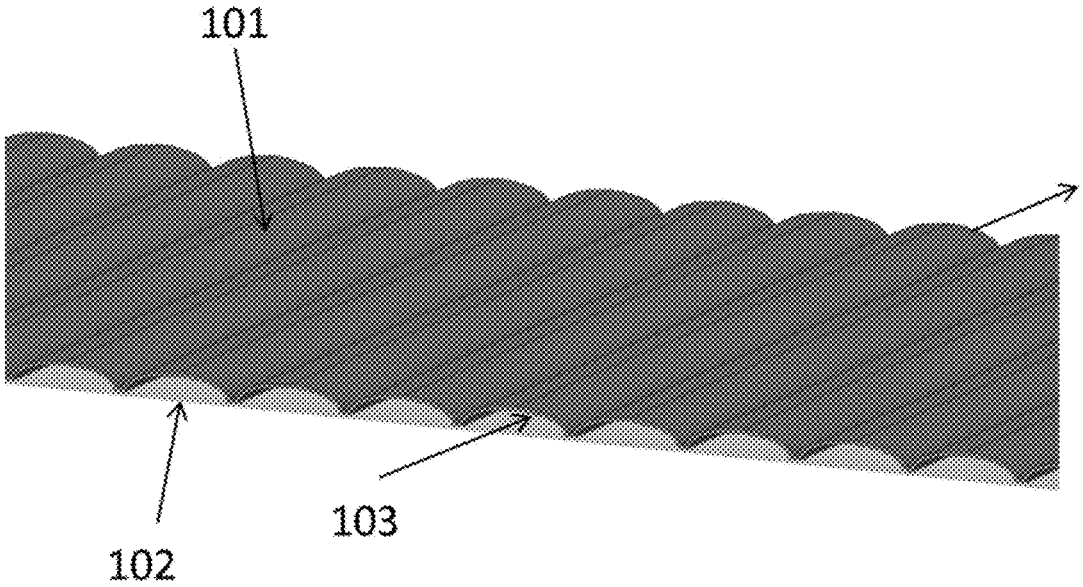
FIG. 15. Plurality of channels made from non-breathable fabric outer layer and a sweat wicking fabric to be used next to skin.
Figure 16:
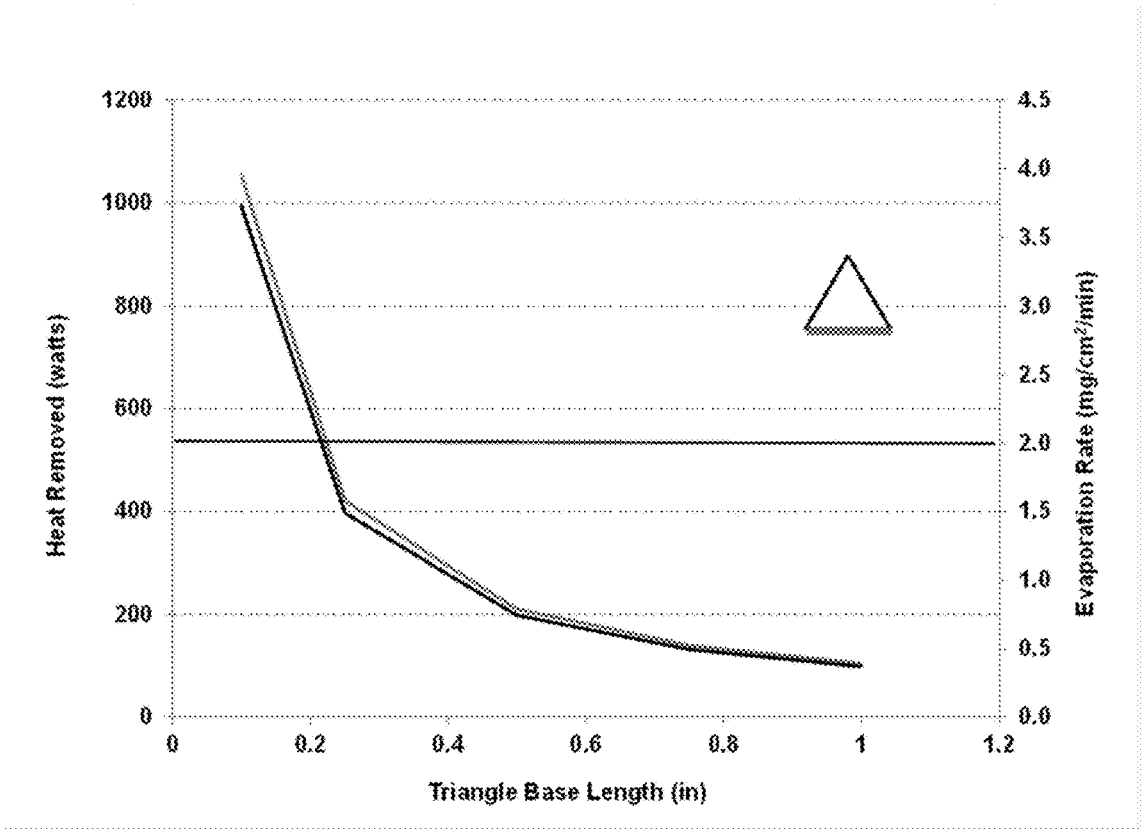
FIG. 16. Sweating and heat removal rates for various sized triangular channels.
Figure 17:
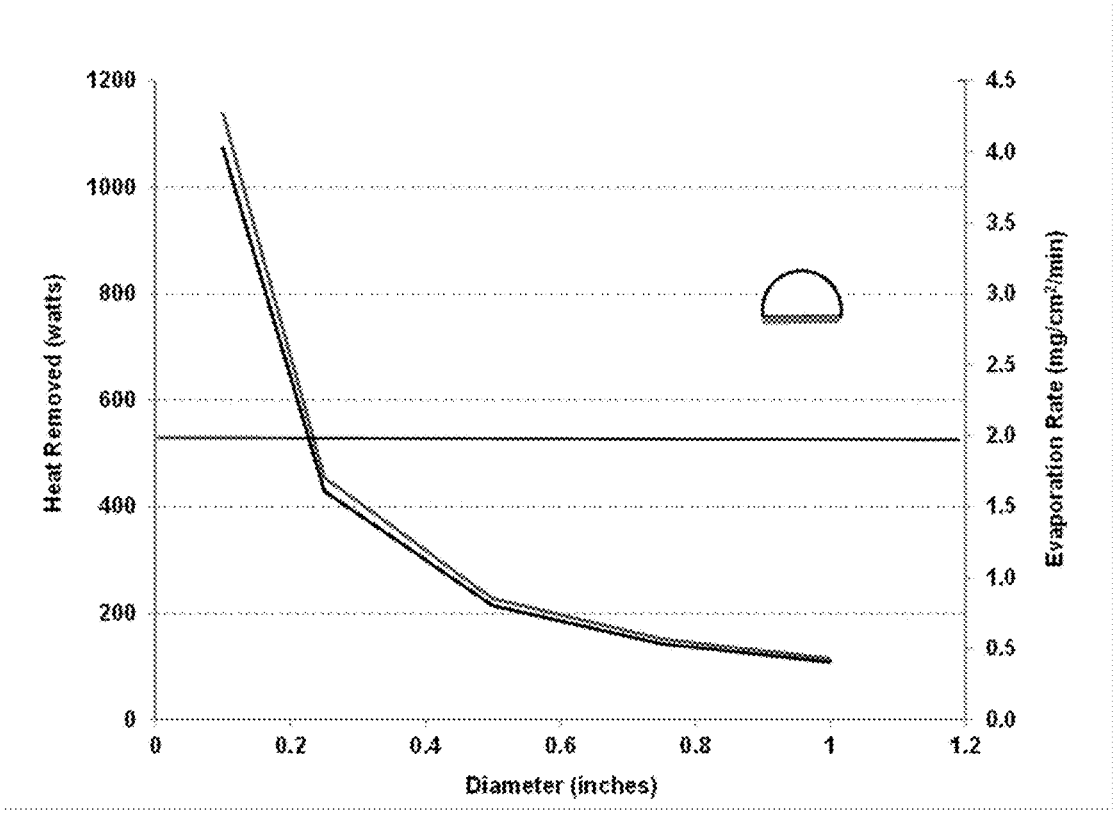
FIG. 17. Sweating and heat removal rates for various sized semicircular channels.

In the cooling garment, we exploit the body's natural, self-regulating, cooling mechanism of sweating. The garment can be designed so that the rate of sweat evaporation is increased to the point where the body can reject all of the heat it generates even when working very hard and the humidity and temperature are high. This is done by incorporating hundreds of small fabric (or plastic or other material) tubes into the shirt, and forcing air through them with a small battery powered fan (FIG. 7). FIG. 7 shows a schematic of a cooling garment, including a snug fitting, sweat-wicking fabric as the base layer (81) to which the air flow channels (82) are attached, an air manifold (83) connected to a fan (84) powered by a battery (85) and where the air flows up torso and out neck and sleeves (86). The garment also has a zipper (87) for easy removal. The small diameter of the tubes increases the rate of sweat evaporation, for example by more than a factor of 50 compared to not using the shirt. A schematic representation of a cross sectional view of how these small tubes/conduits are attached to the cooling shirt is shown in FIG. 4, FIG. 5 and FIG. 15. The shirt consists of at least two layers. A moisture wicking fabric worn next to the skin transports sweat from the skin to the outer surface of the wicking fabric. Stitched to, or otherwise attached to, the wicking fabric is a second pleated layer that has a weave tight enough that most of the air flows through the tubes in FIG. 5 instead of leaking out through the fabric. The pleated fabric does not have to be completely impermeable. FIG. 5 shows a diagram of how fabric layers are attached to form air tubes used for evaporative cooling (cross-section of cooling shirt/vest). The moisture wicking fabric (71) is attached to densely woven fabric (72) with high resistance to air leakage out by attachment points formed from stitching (73) wherein the rows of stitching are about 2 to 3 mm apart, forming air flow passages (74) to cool skin (75). Water from sweat (76) is wicked by inner fabric and evaporates in the air passage, thus cooling the wearer. FIG. 15 shows a plurality of channels made from non-breathable fabric outer layer (101) and a sweat wicking fabric (102) to be used next to skin. The assembly forms air channels (103). FIG. 8 shows a schematic of a cooling garment with a redistribution manifold, including a snug fitting, sweat-wicking fabric as the base layer (91) to which the air flow channels (92) are attached, an air manifold (93) connected to a fan (94) powered by a battery (95) and where the air flows up torso and through thin flow redistribution manifolds (96), in case some channels are pinched, and then flows out sleeves (97). The garment also has a zipper (98) for easy removal. FIG. 9 shows a cooling garment (10) with a plurality of channels (13), an above ambient pressure supply (14), a manifold (15), and a redistribution manifold (16).

One embodiment of the invention is tubes that are slightly leaky so that even if some tubes get pinched off (by a pack strap for instance), there is still some cooling from these tubes as air leaks out. Importantly though, since the tubes have to be small to work, there are by necessity, many of them (40-400 in a typical shirt). Therefore if a large number of tubes were pinched off by packs, belts etc., the garment would still retain some of its cooling capacity.

Wearing the cooling garment is like using a fan, except that the garment is more efficient at cooling. Even when the humidity is very high (and therefore the driving force for the evaporation of water is small), a fan increases the rate of sweat evaporation when air is moving rapidly over the skin (i.e. forced convection). This occurs because the heat and mass transfer coefficients (that determine the rate of sweat evaporation) are much higher for flow in a small tube than flow over a large surface. The cooling garment works better than a fan alone because the heat and mass transfer coefficients for small tubes are high because they are inversely proportional to their diameter; hence the large number of small tubes attached to the shirt greatly increases the rate of sweat evaporation. Another advantage of the cooling garment is that it uses the body's natural cooling mechanism of sweating as its control system. Overcooling and cold spots are essentially impossible because the body regulates its own temperature—if one's body gets too cold, sweating stops and there is less evaporative cooling, if too hot, sweating resumes along with evaporative cooling.

In one embodiment the garment has interconnecting channels mid-way down their length to let the flow re-route itself around obstructions such as pinched off tubes. Cooling vests designed for crush resistance can use a heat sealing method where plastic tubing material is melted into the fabric. In vests that can be more flexible, fabric tubing (coated on the inside so as not to leak too much air) could be stitched onto the wicking garment.

In one example the garment is a shirt designed so that the rate of sweat evaporation is increased to the point where the body can reject all of the heat it generates even during hard work in hot-humid climates. This is done by incorporating about 40-400 small fabric channels into the shirt, and forcing air through them with a small battery powered fan at a total flow rate of about 10-15 $ft^3$/min.

The small hydraulic diameter of the channels increases the mass transfer coefficient for evaporating water by a factor of up to about 50 (compared to still air), which permits sweat to evaporate at a rate that can keep up with the rate of sweat production. The moisture wicking fabric is worn next to the skin and transports sweat from the skin to the outer surface of the wicking fabric. Puff-printing of foam (raised printing that is a common method of making decorative tee shirts) is one method that can be used to make the channel walls. This material could also act as an adhesive to hold the impermeable layer on top. Other methods of channel construction and fabric joining including knitting, RF welding, heat welding, stitching and gluing. Using an impermeable layer on top ensures that the air flows through the channels where the rate of water evaporation in high (rather than out of the fabric where the advantage of higher mass transfer rates for water would be lost). The channel walls are flexible so that the shirt does not interfere with movements of the wearer. The channels are attached to a fabric air manifold so that if some channels are pinched closed, then the flow of air simply detours to other open channels. A variety of manifold designs can deal with the related issues of increasing heat/mass transfer rates, increasing flow rate, decreasing pressure drop and preventing/mitigating the effects of channels being crushed or pinched off. Also, the shirt can be equipped with zippers so the wearer can take it off in the field.

The key to getting evaporative cooling to work in high humidity (where the driving force for evaporation is low) is to design the system so that the mass transfer coefficient for water evaporation is large. The total amount of heat removed is given by equation 4.

$$\text{Heat removed}=Q=\dot{m}_{sweat}\Delta H_{vap} \quad (4)$$

where the rate of sweat evaporation ($\dot{m}$) in lb/h multiplied by the heat of vaporization of water ($\Delta H_{vap}$=1000 Btu/lb).

The rate of water (sweat) evaporation (m) depends on the mass transfer coefficient ($k_{MT}$) and the driving force for evaporation as shown FIG. 18. $A_{MT}$ is the area for mass transfer, which in the case of the shirt is approximately the area of the torso and upper arms. The mass flux ($m/A_{MT}$) can be expressed as a simple linear relationship in water vapor concentration difference because all of the non-linear effects of the diffusion of water molecules in air, gas viscosity, and other fluid properties are lumped into the mass transfer coefficient. FIG. 18 shows the water vapor flux equation ($kg/m^2/h$), the mass flux, or the mass flow rate (111) divided by the area for mass transfer (112) equals the mass transfer coefficient (113) time the difference of the concentration of water vapor next to the skin (114) minus the concentration of water vapor in the environment (115).

Example 1: Half Circle Channels

A shirt that contains about 44 channels where the channels are half circles with a 1.0-inch diameter. This garment removes about 114 Watts for a sweating wearer.

Example 2: Half Circle Channels

A shirt that contains about 88 channels where the channels are half circles with a 0.5-inch diameter. This garment removes about 228 Watts for a sweating wearer.

Example 3: Half Circle Channels

A shirt that contains about 88 channels where the channels are half circles with a 0.25-inch diameter. This garment theoretically removes about 455 Watts for a sweating wearer, which may exceed the theoretical maximum based on the sweating capacity of the wearer.

Example 4: Plurality of Channels

Figure 12:
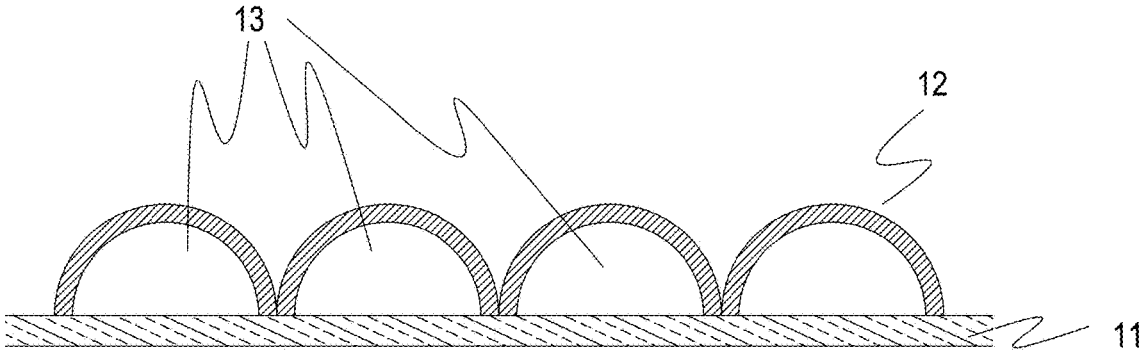
FIG. 12. Semi-circular channel.
Figure 12:
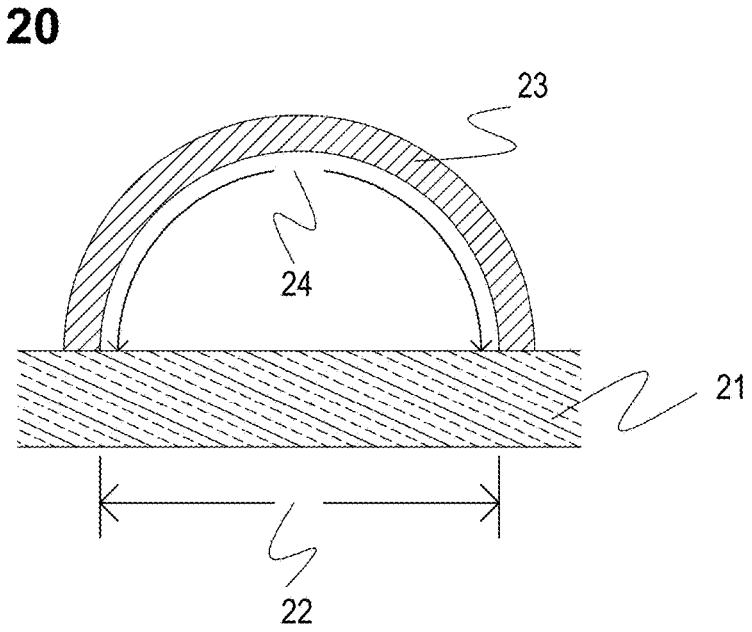

A shirt that contains about 88 channels where the channels are half circles with a 0.5-inch diameter and the channels are arranged so that they are adjacent to their nearest neighbor (see FIG. 12).

Example 5: Plurality of Channels

Figure 14:
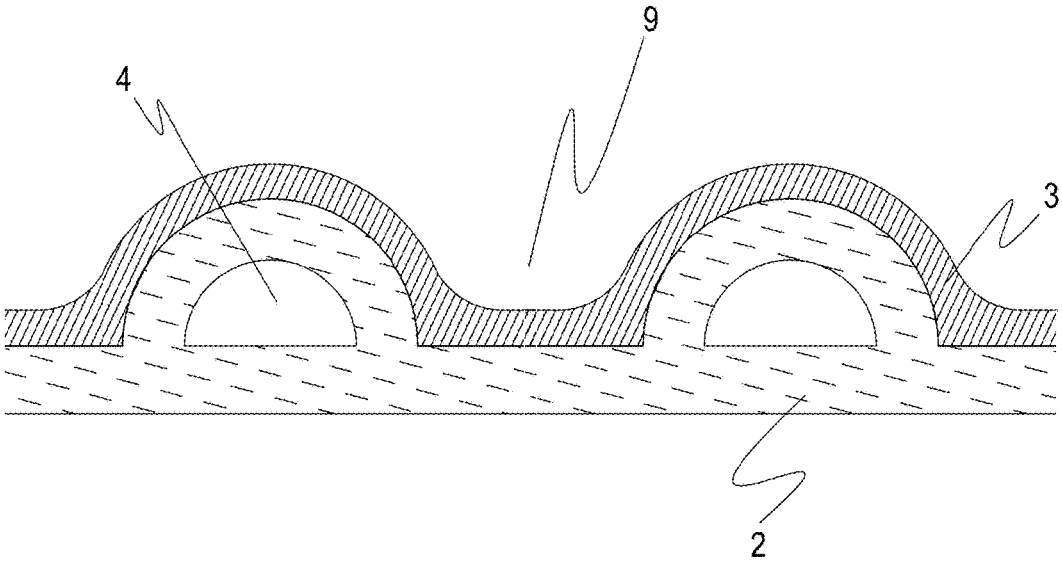
FIG. 14. Optional channel structure where there is a gap separating channels.

A shirt that contains about 44 channels where the channels are half circles with a 0.5-inch diameter and the channels are arranged so that there is a gap (9) between the channels (see FIG. 14).

Example 6: Triangle Channels

A shirt that contains about 44 channels where the channels are equilateral triangles with a 1.0-inch side. This garment removes about 105 Watts for a sweating wearer.

Example 7: Triangle Channels

A shirt that contains about 88 channels where the channels are equilateral triangles with a 0.5-inch side. This garment removes about 211 Watts for a sweating wearer.

Example 8: Rectangular Channels

A shirt that contains about 44 channels where the channels are rectangles with a 1-inch length and 0.5-inch height. The wetted perimeter is 3 inches. This garment removes about 105 Watts for a sweating wearer.

Example 9: Rectangular Channels

A shirt that contains about 22 channels where the channels are rectangles with a 2.0-inch length and 0.5-inch height. The wetted perimeter is 5 inches. This garment removes about 62 Watts for a sweating wearer.

Example 10: Rectangular Channels

A shirt that contains about 88 channels where the channels are rectangles with a 0.5-inch length and 0.5-inch height. The wetted perimeter is 2 inches. This garment removes about 195 Watts for a sweating wearer.

Example 11: Rectangular Channels

A shirt that contains about 88 channels where the channels are rectangles with a 0.5-inch length and 0.25-inch height. The wetted perimeter is 2 inches. This garment removes about 580 Watts for a sweating wearer.

Example 12

Figure 13:
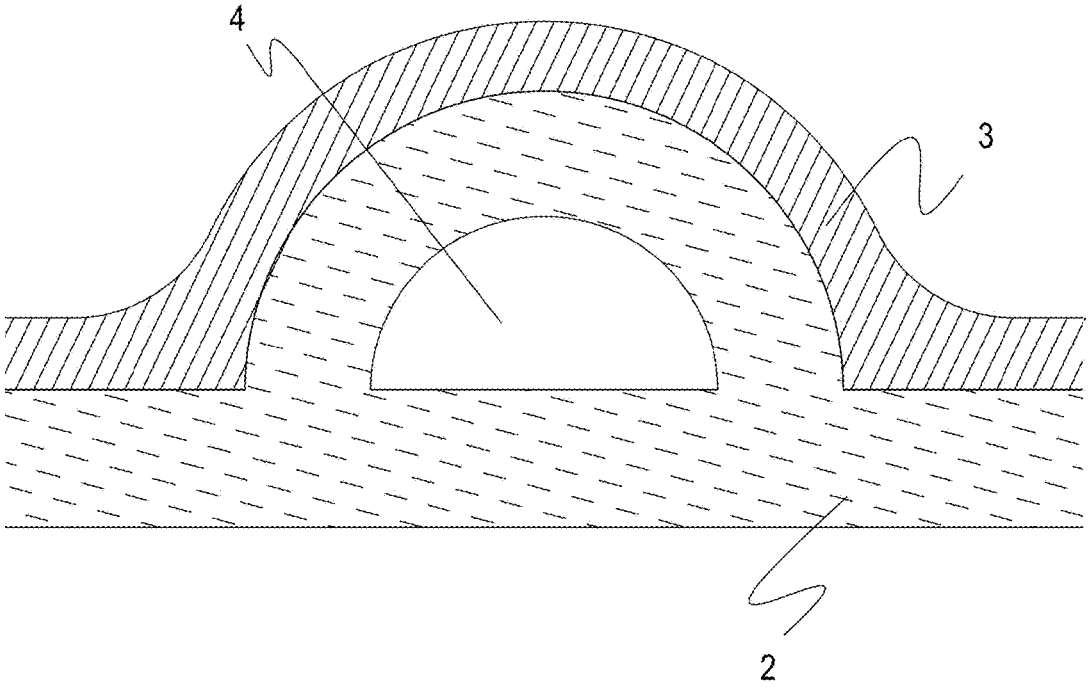
FIG. 13. Optional channel structure where the channel is surrounded by wicking layer and outer layer is attached to wicking layer.

A shirt that contains about 88 channels where the channels are half circles with a 0.5-inch diameter. The channels a surrounded by the wicking material (see FIG. 13), and the outer layer is a urethane coating applies to the outer surface of the wicking layer (for example see drawing reference #(3) in FIG. 13.

Example 13

Cooling garment used when $T_{db}$=88° F. (31° C.) and dew point of 78° F. (26° C.), which gives $T_{wb}$=80° F. and RH=72% (absolute humidity=0.0205 $lb_{water}/lb_{dry\ air}$). The garment operates for 4 hours on a single battery charge. The vest can cool an individual even during very heavy work, with 2000 Btu/hr (586 W) of metabolic heat. The garment weighs less than 4 pounds.

The mass transfer calculations are as follows. The flux of water vapor from evaporating sweat is given by:

$$N_w/A=k_{MT}(C_{sat}-C_{vap}) \quad (1)$$

where $N_w$ is the number of moles of water vapor that pass across body/garment area A, per unit time, $C_{vap}$ is the concentration of water vapor in the ambient air (determined by the humidity), $C_{sat}$ is the equilibrium vapor concentration of water from the sweat on the body, and $k_{MT}$ is the mass transfer coefficient. The mass flux can be expressed as a simple linear relationship in water vapor partial pressure (concentration) difference because the highly non-linear effects of, the diffusion of water molecules in air, gas viscosity, and other fluid properties are all lumped into the mass transfer coefficient.

The cooling tubes in the garment are long (about 24 in, 60 cm) and have small inside diameters (0.1 inch). Because the air flows through narrow tubes, the air is in laminar (streamline) flow. The mass transfer of water occurs when the sweat wicks into the garment material, and then into the array of small tubes containing the air flow (driven by the fan). To calculate the maximum rate of water (sweat) evaporation, the cooling garment is modeled as water evaporating from a series of long, narrow parallel strips of fabric into a laminar flow of air inside the tubes. This flow geometry is essentially a rectangular flat plate:

$$\frac{k_{MT}L}{D}=0.332\left(\frac{Lv^{o}}{\nu}\right)^{1/3}\left(\frac{\nu}{D}\right)^{1/3} \quad (2)$$

The variables in equation 2 are: $k_{MT}$ is the mass transfer coefficient, L is the hydraulic diameter of the 2.5 mm tubes, ν is the kinematic viscosity of air (40° C.) $v^0$ is the air velocity in the tubes, and D is the binary diffusion coefficient for water in air (D=0.277 $cm^2$/sec).

At a skin temperature at 95° F. (35° C.), the vapor pressure of water is 0.82 psia (5.7 kPa). The ambient air design point conditions are a dry bulb temperature of 88° F. (31.1° C.) and a wet bulb temperature of 80° F. (27° C.). Under these conditions, the relative humidity is 72% and the dew point is 78° F. (25° C.). The water concentration is 0.02046 g/g of dry air. The concentration of water vapor right next to the skin is therefore $2.18\times10^{-6}$ mole/$cm^3$ and the concentration in the humid air is $1.47\times10^{-6}$ mole/$cm^3$. With these values, the maximum theoretical water vapor flux is about $N_W$=92 mole/$m^2$/h (2.8 mg/$cm^2$/min). For an air velocity of 1.6 m/s in the tubes (total air flow of 10 $ft^3$/min), the mass transfer coefficient was $k_{MT}$=4.85 cm/s.

A commonly used method for estimating the body surface area (BSA) is the Mosteller formula:

$$BSA\ (m^2)=\{(Height\text{-}cm)(Weight\text{-}kg)/3600\}^{0.5}$$

A commonly used BSA for physiological calculations is 1.8 $m^2$, which using the Mosteller formula corresponds to an individual that weighs about 143 lb (65 kg) and is 5 ft 10 inches (1.8 m) tall. In general, the BSA breaks down approximately as: head=9%, chest=9%, abdomen=9%, lower torso=18%, arms (9% each), groin=1% and legs=18% each. Assuming that the shirt has long sleeves and covers the front and back from chest to waist, the total surface area covered by the cooling garment is about 40% of the body's surface area, or 0.73 $m^2$ for a 1.8 $m^2$ person. The improvement in mass transfer comes from the fact that for a fixed area, the mass transfer coefficient ($k_{MT}$) inside a tube at a linear flow rate of 1.6 m/s, which increases the rate of that water (as sweat) can evaporate from the shirt by a factor of 50.

The rate of heat transfer by evaporative cooling can be determined by the mass flux of water:

$$Q_{heat}=(N_w/A)(\Delta H_{vap}) \quad (3)$$

Where $Q_{heat}$ is the heat that can be removed, ($N_w$/A) is the flux of water being evaporated and ΔH is the heat of vaporization of water (555 kcal/kg, 1000 Btu/lb). When the skin temperature is 35° C. (95° F.), the theoretical maximum heat transfer rate is about 977 W (3332 Btu/hr) with a total air flow through 440 tubes of 10 $ft^3$/min. The number of tubes was calculated by assuming a vest sized for a large male having a chest measurement of 44 inches (112 cm) where the small tubes were arranged side-by-side around the body. These calculations show that the cooling garment can remove 586 W of metabolic heat (corresponding to very heavy work) even with a garment efficiency of only 60%. Higher efficiencies lead to higher heat removal. Likewise, this means that the system could remove most or all of the worker's metabolic heat load, even if some of the air tubes were crushed shut by a pack or harness, or blocked by clothing. Also, because the evaporation of sweat is the cooling mechanism, less heat is removed during periods of lower metabolic heat generation (such as when resting) because less sweat is produced, and therefore the system will not overcool the worker.

Example 14: Cooling Shirt

The cooling channels in the shirt are about 24 inches long and have small inside diameters (0.1 tall×0.1 inch wide). In order to calculate the mass flux ($m/A_{MT}$) and therefore the cooling rate, an appropriate correlation for the mass transfer coefficient ($k_{MT}$) is used, such is understood by A Person Having Ordinary Skill in the Art. At a flow rate of 10 $ft^3$/min with approximately 440 channels, the flow is laminar (the Reynolds number is about 248 and the velocity in each of the 440 tubes is 1.66 m/s).

A cooling shirt uses a wicking fabric that is worn next to the skin with an outer, air impermeable fabric layer separated into a series of small air channels. Assuming that the shirt has short sleeves and covers the front and back from chest to waist, the total surface area covered by our shirt would be about 40% of the body's surface area, or 0.73 $m^2$ for a 1.8 $m^2$ person (40.5%).

What is claimed is:

1. A cooling shirt or vest garment, the cooling garment formed of:

(a) a moisture-wicking under layer;

(b) an impermeable outer layer, wherein an impermeable outer layer is attached to the outer surface of the moisture-wicking under layer;

(c) at least one channel within the moisture-wicking under layer having an internal wetted perimeter of at most 5 inches and said impermeable outer layer; and (d) an above ambient pressure gas supply operably attached to the channel to thereby cool the wearer of the cooling garment.

2. The garment of claim 1, further comprising at least two channels, wherein the two channels are substantially adjacent to each other.

3. The garment of claim 1, further comprising at least two channels, and at least one gap, wherein the two channels are separated by the gap.

4. The garment of claim 1, wherein hydraulic diameter of the channel is at most 1 inch.

5. The garment of claim 4, wherein hydraulic diameter of the channel is about 0.5 inches.

6. The garment of claim 1, wherein the above ambient pressure gas supply is either a fan, a positive displacement pump, or a compressed gas tank.

7. The garment of claim 1, wherein the garment is a shirt or a vest with at least 20 channels.

8. A cooling shirt or vest garment, the cooling garment formed of:

(a) a moisture-wicking under layer;

(b) an impermeable outer layer, wherein the impermeable outer layer is attached to the moisture-wicking under layer forming a plurality of channels, wherein each channel is formed in part from the moisture-wicking under layer and in part from the impermeable outer layer, and each of the channels has an internal perimeter comprising:

(i) a wicking layer segment having a wicking layer internal perimeter segment length of at most 2 inches;

(ii) an outer layer segment having an outer layer internal perimeter segment length of at most 3 inches; and (c) an above ambient pressure gas supply operably attached to the channels with a manifold to thereby cool the wearer of the cooling garment.

9. The cooling garment of claim 8, wherein the wicking layer internal perimeter segment length is at most 0.2 inches.

10. The garment of claim 1, wherein the channels are semicircular tubes with a diameter from 0.04 to 1.0 inches.

11. The garment of claim 10, wherein the channels have a diameter of about 0.5 inches.

12. The garment of claim 10, wherein the channels have a diameter from 0.04 to 0.2 inches.

13. The garment of claim 10, wherein the garment is a shirt with 300 to 400 channels.

14. The garment of claim 8, wherein the garment is a shirt or a vest with at least 20 channels.

15. The garment of claim 8, wherein the channels are triangular pleats and the wicking layer internal perimeter segment length is from 0.04 to 1.0 inches.

16. The garment of claim 15, wherein the wicking layer internal perimeter segment length is from 0.04 to 0.2 inches.

17. The garment of claim 8, wherein the channels further comprise an airflow direction that is either substantially up, substantially down, or substantially horizontal, or combinations thereof.

18. The garment of claim 8, wherein the garment further comprises at least one redistribution manifold.

19. The cooling garment of claim 8, wherein at least one of the channels has a cross section further comprising:

(iii) at least one wall segment, having a wall internal perimeter segment length of at most 0.5 inches; and wherein the channel has a total wetted perimeter of no more than 5 inches.

20. The garment of claim 19, wherein the channels are substantially rectangular channels with a wicking layer internal perimeter segment length from 0.1 to 1.0 inches, an outer layer internal perimeter segment length from 0.1 to 1.0 and a wall internal perimeter segment length from 0.1 to 0.5 inches.

* * * * *